US005947573A

United States Patent [19]

Tovar et al.

[11] Patent Number: 5,947,573

[45] Date of Patent: Sep. 7, 1999

[54] REFRIGERATOR AND COMPARTMENT THEREFOR

[75] Inventors: Virgilio O. Tovar; Michael W. Greenwood, both of Newburgh, Ind.

[73] Assignee: Whirlpool Corporation, Benton Harbor, Mich.

[21] Appl. No.: 08/967,837

[22] Filed: Nov. 12, 1997

[51] Int. Cl.[6] ..... A47B 96/04; A47B 88/00

[52] U.S. Cl. ..... 312/404; 312/330.1; 312/311

[58] Field of Search ..... 312/332.1, 333, 312/330.1, 404, 408, 295, 301, 311; 62/382; 220/545, 544, 592.02

[56] References Cited

U.S. PATENT DOCUMENTS

| | | | |
|---|---|---|---|
| 1,314,628 | 9/1919 | Willman | 312/311 X |
| 2,116,370 | 5/1938 | Watkins | 312/333 X |
| 2,132,737 | 10/1938 | Kahn | 312/333 X |
| 2,776,866 | 1/1957 | Hanbison | 312/311 |
| 2,801,146 | 7/1957 | Mikulas | 312/301 |
| 3,009,338 | 11/1961 | Dobbie | 62/119 |
| 3,227,505 | 1/1966 | Ambaum | 312/330.1 X |
| 3,339,994 | 9/1967 | Reddig et al. | 312/301 |
| 3,883,205 | 5/1975 | Ambaum et al. | 312/330.1 |
| 4,732,435 | 3/1988 | Bailey et al. | 312/311 |
| 5,095,717 | 3/1992 | Germi | 62/382 |

FOREIGN PATENT DOCUMENTS

| | | | |
|---|---|---|---|
| 522217 | 2/1956 | Canada . | |
| 3307994 | 9/1984 | Germany | 312/311 |
| 8002453 | 11/1981 | Netherlands | 312/332.1 |
| 559030 | 2/1944 | United Kingdom . | |

*Primary Examiner*—Peter M. Cuomo
*Assistant Examiner*—James O. Hansen
*Attorney, Agent, or Firm*—Robert O. Rice; Joel M. Van Winkle; Thomas J. Roth

[57] ABSTRACT

A container for a refrigerator in which the container comprises a pan having an access opening, which is covered by a door pivotally mounted to the pan. The pan is slidably mounted within the refrigerator in a conventional manner. The door has opposing fingers extending from the side edges thereof and a hook extending from the top edge thereof. As the pan is slid outwardly from the refrigerator, the fingers abut liner studs extending from the inner liner of the refrigerator to partially rotate the door from a closed position toward an open position. On the continued sliding of the pan, the hook abuts a sloped surface of the liner to continue the rotation of the door completely into the open position.

20 Claims, 3 Drawing Sheets

REFRIGERATOR AND COMPARTMENT THEREFOR

BACKGROUND OF THE INVENTION

1. Field of the Invention

The invention relates to a refrigerator having a container for storing goods, and more specifically to a container movably mounted within the refrigerator and constructed so that it automatically opens upon its movement.

2. Description of the Related Art

Contemporary refrigerators have a variety of means for storing the goods placed in the refrigerator. The storing means can vary from open shelves to closed containers. Closed containers are commonly used when it is desired to maintain a higher moisture level in the container than in the general refrigeration compartment, such as a crisper, or when it is desired to maintain the temperature in the container below the temperature of the refrigerator but still above freezing, such as in a chiller container. The crisper container is generally placed near the bottom of the fresh food compartment and comprises a drawer slidably mounted to the underside of a shelf, which forms the top closure for the crisper. The drawer must be manually slid by the user to obtain access to the crisper. Likewise, most chillers are manually operable and comprise a movably mounted drawer whose top or front has a hingedly mounted cover that must be manually operated to open the container to obtain access to its interior. Most chillers are open to a cool air outlet of the refrigeration system to maintain the chiller at a temperature below the temperature of the refrigerator.

A disadvantage of some of the manually operable containers is that the user must manually open the container in addition to manually moving the drawer, resulting in a two-handed operation of the drawer. A two-handed operation of the drawer. A two-handed operation of the container is consider an inconvenience by many users as a free hand is not available to extract the goods from the drawer or the user must perform the opening of the container in two steps with a single hand, reserving the other hand to remove goods from the container.

SUMMARY OF THE INVENTION

The invention overcomes the disadvantages of the previous containers by providing for the automatic opening of the container upon the moving of the container by the user, which greatly increases the convenience to the user. The invention is a container for a refrigerator with the container comprising a door having at least one access opening that permits access to the drawer interior. The drawer is slidably mounted to the refrigerator. The container further comprises a door, which is pivotally mounted to the drawer at a pivot point. The door is movable between a closed position, which prohibits access to the interior of the drawer, and an open position, which permits access to the interior of the drawer. The door has an arm that abuts a first portion of the refrigerator to pivot the door partially open as the drawer is slid by the user. The door further has a hook that abuts a second portion of the refrigerator to pivot the door and move it into the open position when the drawer is slid.

Preferably, the drawer is sidably movable between a stored position and use position. When the drawer is slid in a direction from the stored toward the use position, the door is pivoted partially toward the open position. When the drawer is slid to the use position, the door is pivoted into the open position.

In the preferred embodiment, there are two arms, each of which extend from opposite edges of the door. The hook extends from an upper longitudinal edge of the door connecting the two side edges on which the arms extend. The arms extend a radial distance from the pivotal point that is less than the radial distance which the terminal end of the hook extends from the pivot point. Thereby, the pivoting of the door caused by the arm abutting a first portion of the refrigerator pivots the hook into a position to abut a second portion of the refrigerator without the arm abutting a second portion of the refrigerator.

Studs are formed in the side walls of the refrigerator liner and extend into the interior of the liner to provide the first portion of the refrigerator against which the arms abut to pivot the door. Also, the refrigerator has a second surface, such as the bottom of a shelf, the bottom of another container, or the sloped surface of the liner to form the second portion of the refrigerator against which the hook abuts to completely rotate the door to the open position and maintain it in the open position.

DESCRIPTION OF THE PREFERRED EMBODIMENT

Figure 1:
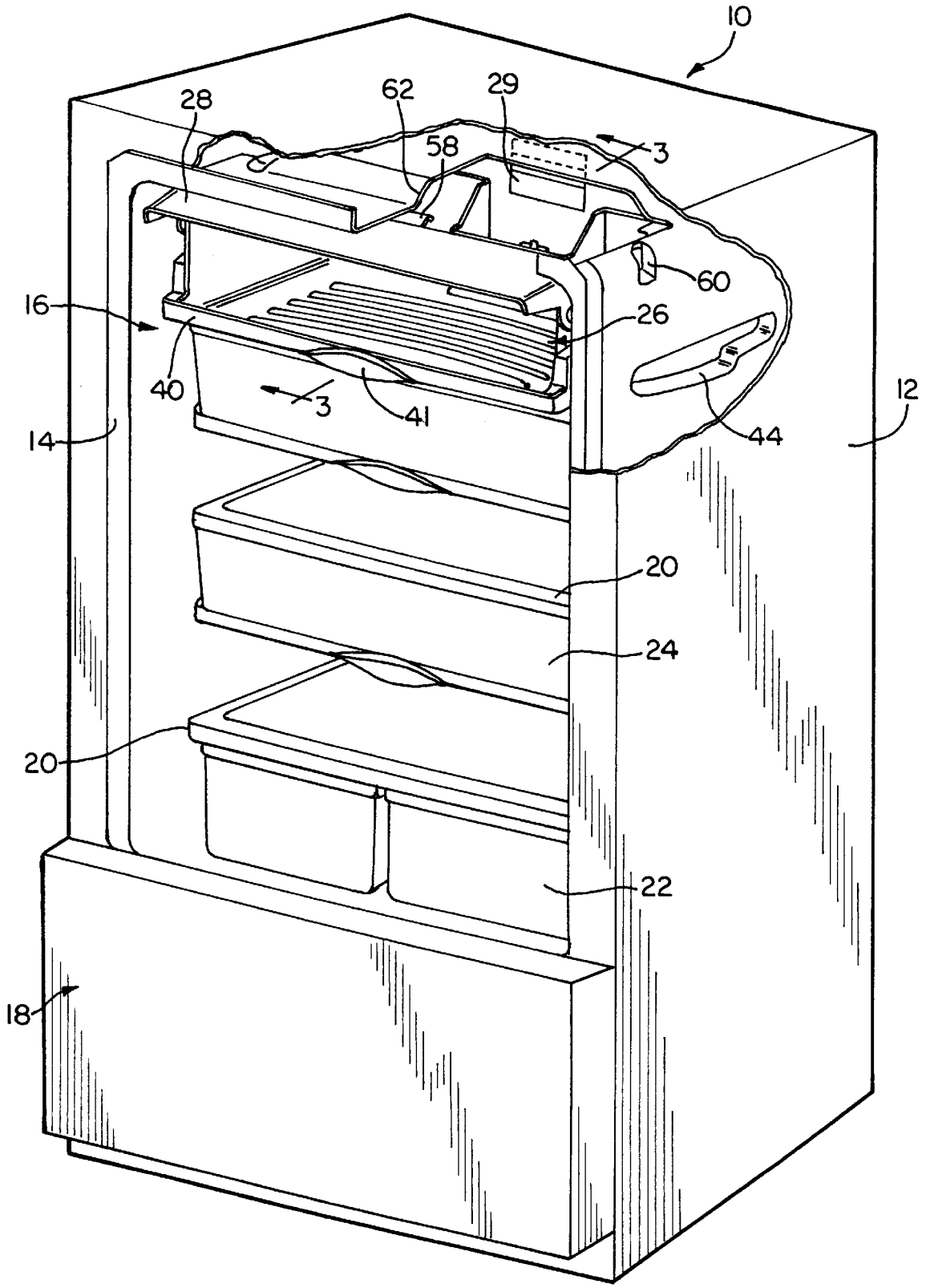
FIG. 1 is an isometric view of a refrigerator and container according to the invention.

FIG. 1 illustrates a refrigerator 10 having an outer cabinet 12 to which is mounted a liner 14. Typically, the liner 14 is mounted to the cabinet 12 by a layer of foamed insulation. The liner 14 divides the refrigerator into two compartments: a fresh food compartment, which is typically kept above freezing, and a freezer compartment 18, which is typically kept below freezing. The refrigerator 10 includes a standard cooling system and control, whose details are not pertinent to the invention.

The fresh food compartment 16 includes a variety of storage devices for storing food items within the fresh food compartment. The storage devices include containers 24 in accordance with the invention along with traditional drawers 22 and shelves 20. The containers 24 comprise a pan 26 to which is pivotally mounted a door 28. One of the containers 24 is positioned adjacent a cool air outlet 29 of the cooling system so the container 24 can function as a chiller.

The pan 26 has a generally rectangular, box-like structure defined by bottom wall 30 (FIG. 2), opposing side walls 32 and 34 and a rear wall 36. The top and front of the pan are left open. Although, in certain applications it may be desirable to close the top or open some of the other walls. The rear wall 36 has an offset portion 38, which is reduced in height, to conform to the back wall of the liner 14 and permit the flow of air from the outlet 29 into the pan.

A lip 40 extends along the lower front of the pan 26 and includes a handle 41. The user can grasp the handle 41 to move the pan 26 relative to the liner 14. A flange 42 is formed at the bottom of each side wall 32, 34 and forms a sliding surface, which abuts a support in the refrigerator on which the pan 26 may slide. Preferably, the support surface is a slide 44 formed in the liner and extending into the fresh food compartment. The sliding surface rests on the slide 44. As is common in this type of mounting, the slide 44 is shaped to abut a stop 45 formed on the side walls 32, 34 to limit the forward travel of the pan 26 relative to the liner 14.

The door 28 comprises an elongated front wall 46 having an arcuate cross section. A pair of arms 48 extend away from the front wall 46. The arms comprise a base portion 52, which is pivotally mounted to the side walls 32, 34 by a pivot pin, which defines a pivot point for the door 28. A finger 56 extends away from the base portion and above the top edge of the side walls 32, 34. A hook 58 extends outwardly from the upper edge of the door 28.

Figure 2:
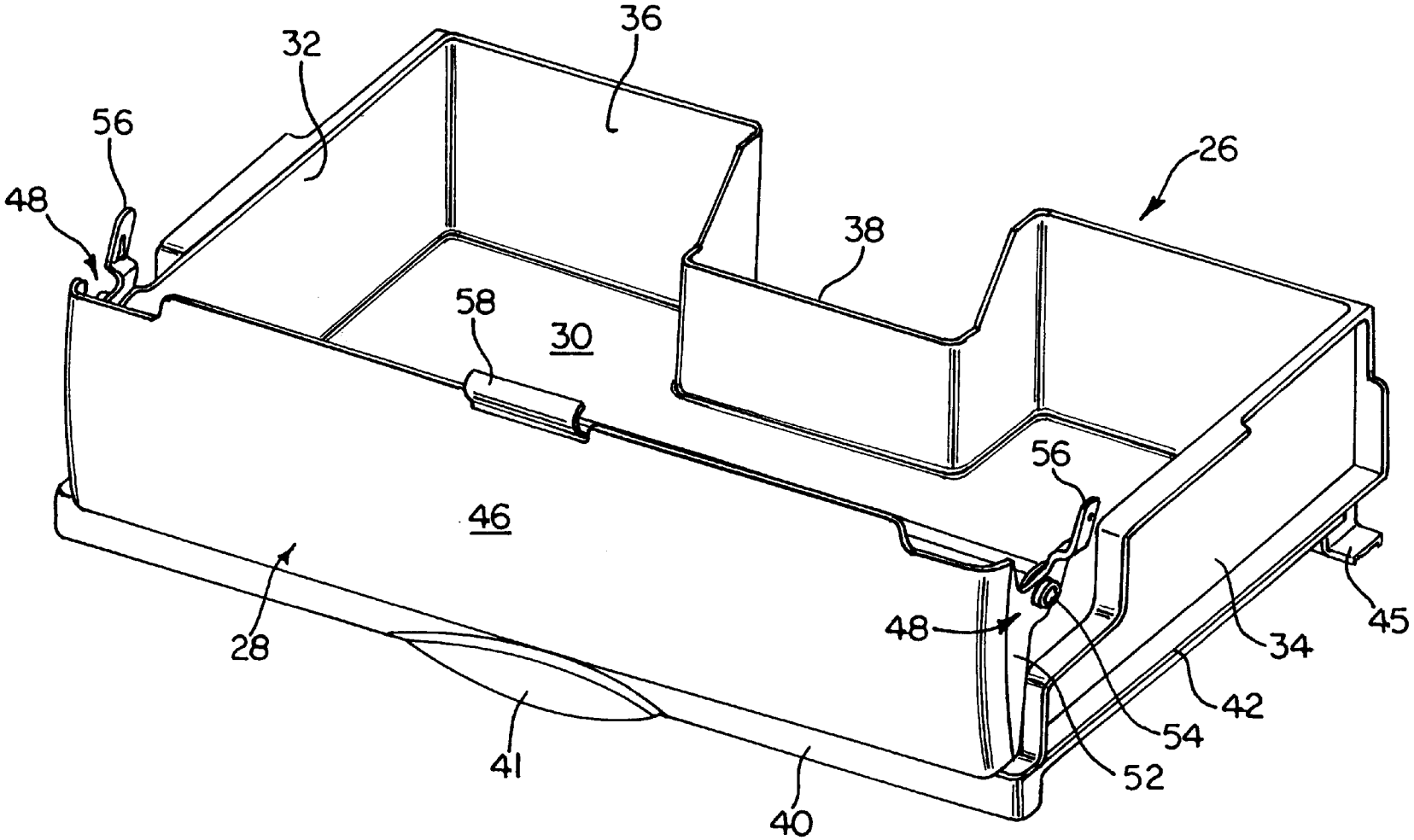
FIG. 2 is an isometic view of the container of FIG. 1.

Preferably, the fingers 56 are sized in lengths so that they will abut liner studs 60 when the pan 26 is slid outwardly relative to the liner by a user pulling on the handle 41 to thereby pivot the door 28 in a clockwise direction, as viewed from FIG. 2 to begin opening the door 28. The door 28 is sized to cover the access opening defined by the front edges of the side walls 32, 34 and the bottom wall 30. The hook 58 is sized so that it will abut a sloped surface 62 formed in the top of the liner 14. Preferably, the hook is sized so that it extends a radial distance away from the pivot point that is greater than the distance the finger extends from the pivot point. In this manner, the hook can still contact the sloped surface of the top of the liner even after it has been rotated downwardly by the finger contacting liner stud 60.

It should be noted, that the size of the hook and the finger are illustrated in the context of the preferred embodiment where the container 24 is mounted adjacent to the top surface of the liner. It is within the scope of the invention for the hook to abut a variety of different structural features within the refrigerator. For example, it is contemplated that the containers 24 may be stacked one upon another and that the bottom surface of one container serves as the surface against which the hook of a below-mounted container abuts and the bottom surface of a shelf could serve as the surface against which the hook abuts.

Figure 3:
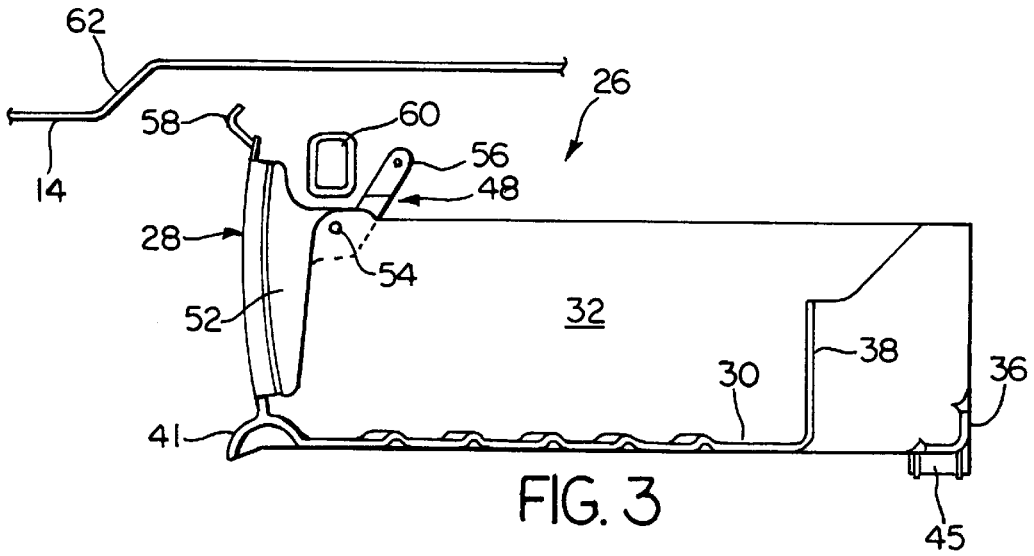
FIG. 3 is a sectional side view of the container taken along line 3—3 of FIG. 1, illustrating the container in a closed position relative to the refrigerator.
Figure 4:
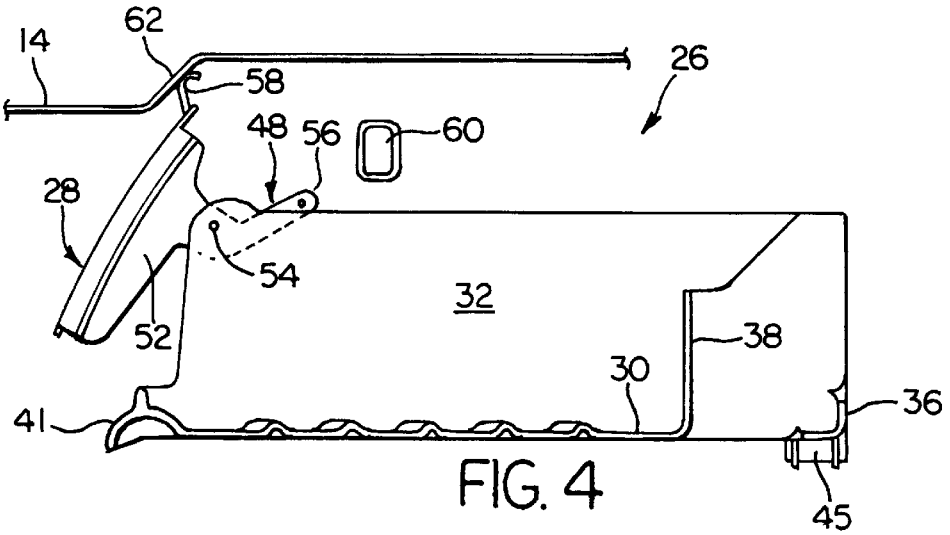
FIG. 4 is a sectional side view similar to FIG. 3, illustrating the container in the partially open position.
Figure 5:
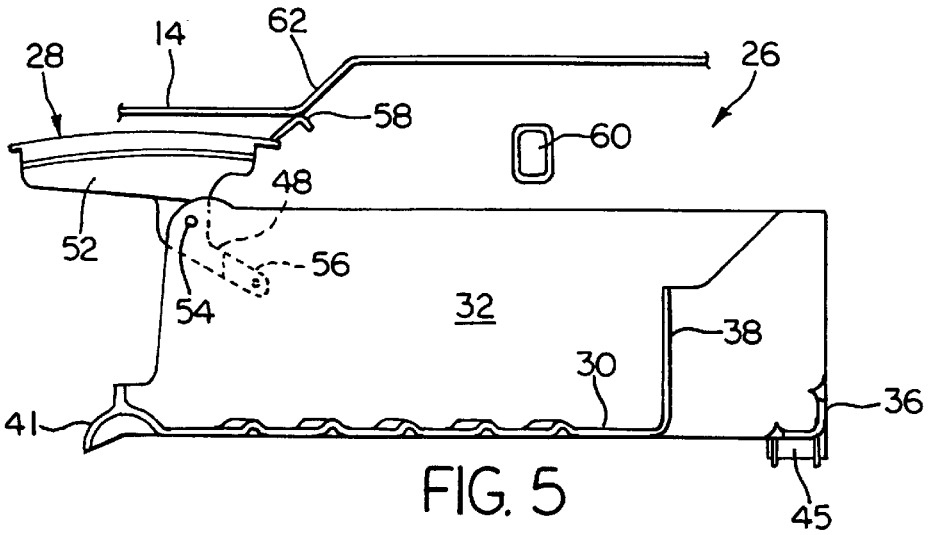
FIG. 5 is a sectional side view similar to FIG. 3, illustrating the container in the open position.

FIGS. 3 through 5 illustrate the operation of the container 24 in which the door 28 is automatically pivoted when the user slides the drawer outwardly relative to the liner 14 and the door is held in the open position without the user having to manually operate the door. In FIG. 3, the container is illustrated in a stored position where the sliding surface of the flange 42 rests on the slide 44 of the liner and the rear wall 36 of the pan is positioned near the rear wall of the liner 14. In this stored position, the door 28 seals the access opening to the pan 26. Also, when the pan 26 is in the stored position, the fingers 56 remain out of contact with the liner stud 60 and the hook 58 remains out of contact with the sloped surface 62 of the top of the liner 14.

A user then grasps the handle 41 along the lip 40 of the pan 26 and pulls the pan outwardly relative to the liner, sliding the pan 26 relative to the liner stud 60. In the position illustrated in FIG. 4, the pan 26 has been slid to the point after the finger has abutted the liner stud 60 and where the hook 58 is just making contact with the sloped surface 62. As can be seen, as the pan 26 was being pulled by the user to this position, the finger 56 contacted the liner stud 60 to rotate the door 28 in a clockwise direction as viewed from FIG. 3. As the user continues to pull the pan, the door is further rotated, changing the angular orientation of the hook relative to the sloped surface so that the hook will not jam against the sloped surface and to permit further rotation of the door 28 in response to further outward translation of the pan 26.

FIG. 5 illustrates the container 24 in a use position where it has been pulled by a user to its furthest position outward relative to the liner 14. In the use position, the hook 58 abuts the sloped surface 62 and is forced thereagainst to rotate the door 28 into the open position and hold the door 28 in the open position. In this position, the user can gain access to the interior of the pan through the access opening that is no longer covered by the door 28.

By reversing the movement of container 24, the user is able to move the container from the use position to the stored position and thereby automatically move the door 28 from its open position to its closed position. Therefore, it can be seen that the invention permits a user to open the container 24 with a single hand merely by sliding the container 24 from a stored position to a use position. As the container is slid from the stored position to the use position, the door is automatically opened, permitting access to the interior of the pan by the user with their free hand. This structure greatly improves the convenience for the user of a refrigerator.

We claim:

1. A refrigerator, comprising:

a wall forming an interior compartment having a first portion and a second portion;

a drawer having at least one access opening and an interior, the at least one access opening permitting access to the drawer interior and being slidably mounted to the refrigerator; and a door pivotally mounted to the drawer at a pivot point and movable between a closed position, which prohibits access to the drawer interior, and an open position, which permits access to the drawer interior, the door having an arm that abuts the first portion of a refrigerator to pivot the door and partially move the door to the open position when the drawer is slid outwardly relative to the interior compartment, and the door having a hook that abuts the second portion of the refrigerator to pivot the door and move it to the open position when the drawer is slid further outwardly relative to the interior compartment.

2. The refrigerator as claimed in claim 1, wherein the drawer is slidably movable between a stored and a use position and when the drawer is slid in a direction from the stored position toward the use position, the door is pivoted partially toward the open position, and when the drawer is slid to the use position, the door is pivoted to the open position.

3. The refrigerator as claimed in claim 2, wherein the arm has a terminal end and the terminal end of the arm extends a radial distance from the pivot point that is less than the radial distance the terminal end of the hook extends from the pivot point, whereby the pivoting of the door caused by the arm abutting a first portion of a refrigerator pivots the hook into a position to abut a second portion of a refrigerator without the arm abutting a second portion of a refrigerator.

4. The refrigerator as claimed in claim 3, wherein the drawer has a generally rectangular shape with at least a partially open face disposed between opposing sides of the drawer to define the access opening.

5. The refrigerator as claimed in claim 4, wherein the access opening is elongated and the door comprises:

an elongated front panel having top and bottom edges connected by opposing side edges which are shorter then the top and bottom edges, the panel being sized to cover the access opening;

two arms each of which extends from one of the opposing side edges and each arm being pivotally mounted to one of the sides of the drawer to form the pivot point; and the hook being mounted to the top edge of the front panel.

6. The refrigerator as claimed in claim 1, wherein the terminal end of the arm extends a radial distance from the pivot point that is less than the radial distance the terminal end of the hook extends from the pivot point, whereby the pivoting of the door caused by the arm abutting a first portion of a refrigerator pivots the hook into a radial distance the terminal end of the hook extends from the pivot point, whereby the pivoting of the door caused by the arm abutting a first portion of the refrigerator pivots the hook into a position to abut the second portion of the refrigerator without the arm abutting the second portion of the refrigerator.

7. The refrigerator as claimed in claim 1, wherein the drawer has a generally rectangular shape with at least a partially open face disposed between opposing sides of the drawer to define the access opening.

8. The refrigerator as claimed in claim 7, wherein the access opening is elongated and the door comprises:

an elongated front panel having top and bottom edges connected by opposing side edges which are shorter then the top and bottom edges, the panel being sized to cover the access opening;

two arms each of which extends from one of the opposing side edges and each arm being pivotally mounted to one of the sides of the drawer to form the pivot point; and the hook being mounted to the top edge of the front panel.

9. A refrigerator comprising:

a cabinet having an open front which is closable by a door;

a liner having opposing side walls connected by bottom and top walls and mounted to the cabinet and defining a refrigerated compartment;

a drawer slidably mounted to the liner for movement between a stored position and a use position, and the drawer having an access opening and an interior, the access opening providing access to the interior of the drawer; and a door pivotally mounted to the drawer for pivoting between a closed position for prohibiting access to the drawer interior through the access opening and an open position for permitting access to the drawer interior through the access opening, the door having at least one arm for abutting a first portion of the refrigerator to partially pivot the door between the closed position and the open position as the drawer is slid, and the door further having a hook for abutting a second portion of the refrigerator to completely pivot the door to the open position.

10. A refrigerator as claimed in claim 9, wherein when the drawer is slid in a direction from the stored position toward the use position, the door is pivoted partially toward the open position, and when the drawer is slid to the use position, the door is pivoted to the open position.

11. A refrigerator as claimed in claim 9, wherein the first portion of the refrigerator is a stud extending from the liner.

12. A refrigerator as claimed in claim 11, wherein the stud is integrally formed with the liner.

13. A refrigerator as claimed in claim 12, wherein the stud extends laterally from one of the side walls of the liner.

14. A refrigerator as claimed in claim 9, wherein the second portion of the refrigerator is one of the walls of the liner.

15. A refrigerator as claimed in claim 9, wherein the second portion of the refrigerator is a sloped surface on the one of the walls of the liner.

16. A container as claimed in claim 9, wherein the arm has a terminal end and the terminal end of the arm extends a radial distance from the pivot point that is less than the radial distance the terminal end of the hook extends from the pivot point, whereby the pivoting of the door caused by the arm abutting a first portion of the refrigerator pivots the hook into a position to abut the second portion of the refrigerator without the arm abutting the second portion of the refrigerator.

17. A refrigerator as claimed in claim 16, wherein the first portion of the refrigerator is at least one stud extending from the liner.

18. A refrigerator as claimed in claim 17, wherein the second portion of the refrigerator is a sloped surface on the top wall of the liner.

19. A container as claimed in claim 18, wherein the drawer has a generally rectangular shape with at least a partially open face disposed between opposing sides of the drawer to define the access opening.

20. A container as claimed in claim 19, wherein the access opening is elongated and the door comprises:

an elongated front panel having top and bottom edges connected by opposing side edges which are shorter then the top and bottom edges, the panel being sized to cover the access opening;

two arms each of which extends from one of the opposing side edges and each arm being pivotally mounted to one of the sides of the drawer to form the pivot point; and the hook being mounted to the top edge of the front panel.

* * * * *